US009339911B2

(12) United States Patent
Eriksson

(10) Patent No.: US 9,339,911 B2
(45) Date of Patent: May 17, 2016

(54) METHOD FOR AUTOMATIC SHARPENING OF A BLADE

(71) Applicant: Eriksson Teknik AB, Njurunda (SE)

(72) Inventor: Magnus Eriksson, Njurunda (SE)

(73) Assignee: ERIKSSON TEKNIK AB, Njurunda (SE)

( * ) Notice: Subject to any disclaimer, the term of this patent is extended or adjusted under 35 U.S.C. 154(b) by 0 days.

(21) Appl. No.: 14/525,093

(22) Filed: Oct. 27, 2014

(65) Prior Publication Data

US 2015/0140902 A1 May 21, 2015

Related U.S. Application Data

(60) Provisional application No. 61/905,981, filed on Nov. 19, 2013.

(51) Int. Cl.
*B24B 9/04* (2006.01)
*B24B 3/00* (2006.01)

(52) U.S. Cl.
CPC .. *B24B 9/04* (2013.01); *B24B 3/003* (2013.01)

(58) Field of Classification Search
CPC ..... B24B 9/04; B24B 3/003; B24B 3/00
USPC ..... 451/45, 28, 383, 150, 152
See application file for complete search history.

(56) References Cited

U.S. PATENT DOCUMENTS 3,735,533 A * 5/1973 Salberg ..... B24B 3/003 451/152
3,988,865 A * 11/1976 Weisman ..... B25B 5/08 269/196
7,220,161 B2 * 5/2007 Eriksson ..... B24B 3/003 451/120

* cited by examiner

*Primary Examiner* — Robert Rose
(74) *Attorney, Agent, or Firm* — Fasth Law Offices; Rolf Fasth

(57) ABSTRACT

The method is for sharpening a blade. An automatic sharpening apparatus is provided that has a housing with an elongate opening defined therein. A blade is placed inside the elongate opening. The blade is tightened between self-centered clamp holders. The rotation of the grinding wheel is turned on. The rotating grinding-wheel engages an underside of the blade and automatically moves along the blade by following a contour of the blade. While the grinding wheel moves along the blade, a counter-weight provides a counter-weight to the grinding wheel. The blade is sharpened while the blade is stationary inside the elongate opening of the housing.

7 Claims, 6 Drawing Sheets

METHOD FOR AUTOMATIC SHARPENING OF A BLADE

PRIOR APPLICATION

This US patent application claims priority from U.S. Provisional Patent Application No. 61/905,981 filed 19 Nov. 2013.

TECHNICAL FIELD

The invention relates to a method for automatic sharpening of a blade such as a skate blade.

BACKGROUND AND SUMMARY OF THE INVENTION

Sharpening apparatuses for sharpening blades such as skate blades have been available for decades. However, the prior art sharpening apparatuses are manual and require extensive skills and experience of the person doing the sharpening. This results in varying sharpening results and makes it more difficult for users of skate blades to obtain properly sharpened skate blades. There is a need for an effective sharpening method and apparatus that is easy to use while providing consistent and high-quality sharpening of skate blades.

The method of the present invention provides a solution to the above-outlined problems. More particularly, the method of the present invention is for sharpening a blade. An automatic sharpening apparatus is provided that has a housing with an elongate opening defined therein. A blade is placed inside the elongate opening. The blade is tightened between self-centered clamp holders. The rotation of the grinding wheel is turned on. The rotating grinding-wheel engages the blade and automatically moves along the blade by following a contour of the blade. While the grinding wheel moves along the blade, a counter-weight provides a counter-weight to the grinding wheel. The blade is sharpened while the blade is stationary inside the elongate opening of the housing.

The method further has the step of tightening the clamp holders about the blade by turning a knob.

The method further has the step of sliding protrusions relative to elongate openings.

The method further has the step of turning a threaded lead screw to move a grinding mechanism, supporting the grinding wheel, so that the grinding wheel moves between elongate bars in operative engagement with the grinding mechanism.

The method further has the step of axially adjusting a position of the grinding wheel between the elongate bars.

The method further has the step of the grinding wheel and the counter-weight pivoting about an axle of a support.

The method further has the step of turning an intermediate coupling relative to a threaded fastener both in operative engagement with the grinding wheel to move the grinding wheel relative to the elongate bars.

DETAILED DESCRIPTION

Figure 1:
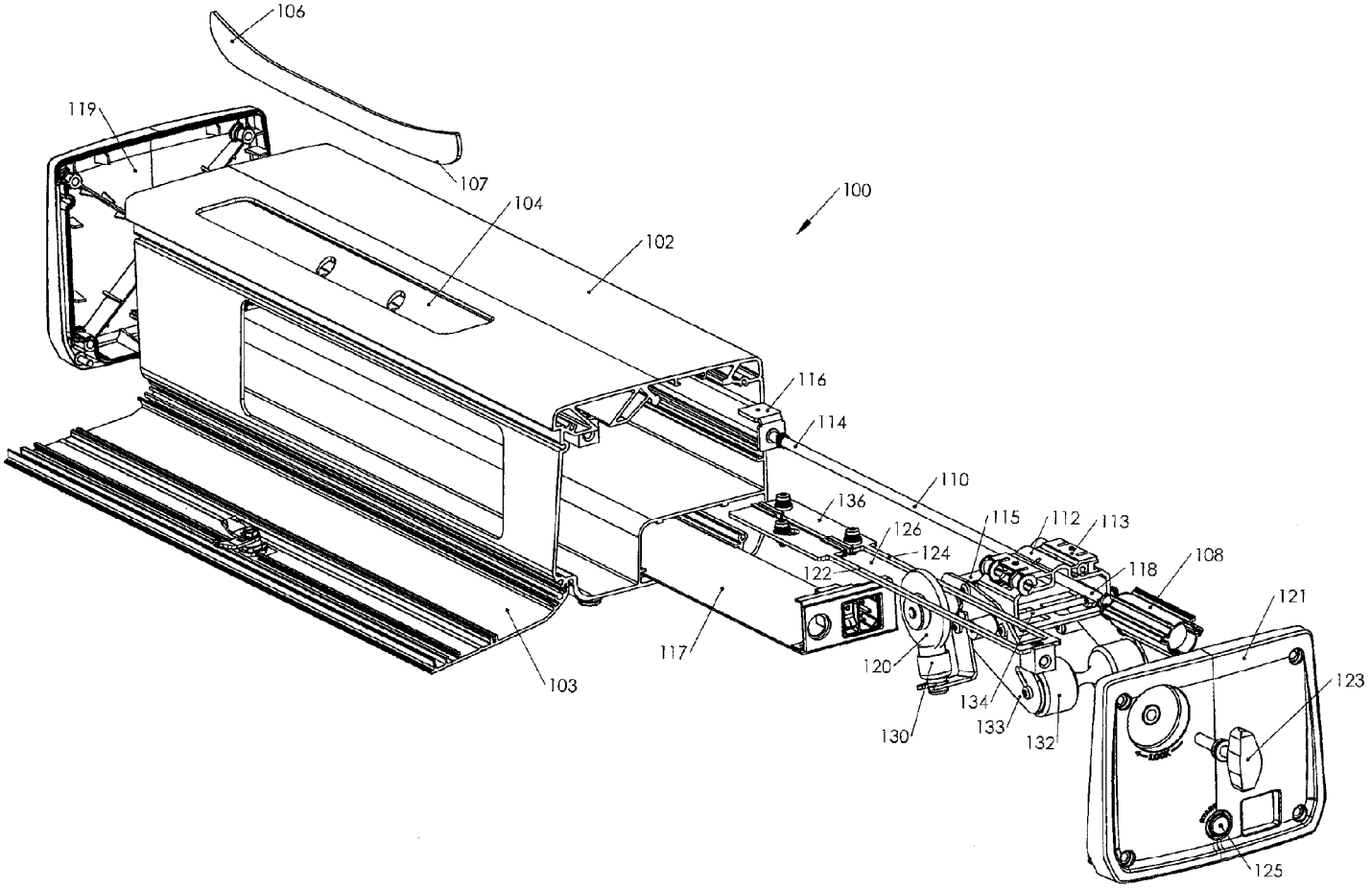
FIG. 1 is a perspective exploded view of the blade sharpening apparatus of the present invention.
Figure 5:
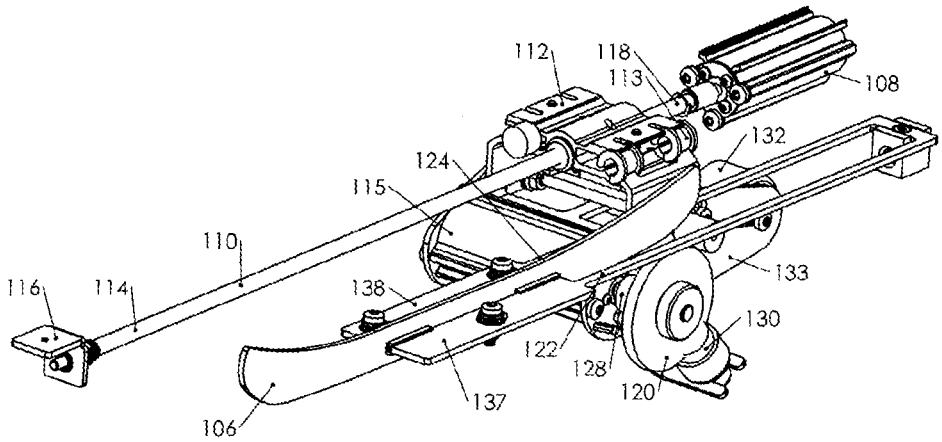
FIG. 5 is a perspective view of a portion of the apparatus having a skate blade clamped therein.

FIG. 1 is a perspective exploded view of the blade sharpening apparatus 100 of the present invention and FIG. 5 is an assembled perspective view of the apparatus 100. One important feature of the present invention is that the sharpening of a blade, such as a skate blade 106, is done automatically by simply placing the blade inside an elongate opening 104 of a rectangular-shaped housing 102 and then turning on the apparatus to start the grinding/sharpening process of the blade 106. More particularly, a motor 108 is operatively attached to a lead screw 110 for moving a grinding mechanism 112 back and forth inside the housing 102. The lead screw 110 is threaded and has one end 114 attached to a fastener 116 that is attached to the wall of the housing 102 and the opposite end 118 attached to the motor 108. The grinding mechanism 112 moves smoothly in a forward or backward direction inside the housing 102 when the motor 108 rotates the lead screw 110. The grinding mechanism 112 has a movable grinding wheel 120 that is placed inside a groove 126 defined between elongate bars 122, 124 so that the grinding wheel 120 can move back and forth inside the groove 126. The grinding wheel 120 is also axially adjustable along the spindle driving the grinding wheel 120 by using a double-thread mechanism so that the wheel 120 is in the correct position inside the groove 126. This adjustment mechanism is shown in detail in FIG. 6 and described below. The bars 122, 124 terminate in a clamping mechanism 136 that is described in detail in FIGS. 3A-3B and 4A-4B below.

Figure 2A:
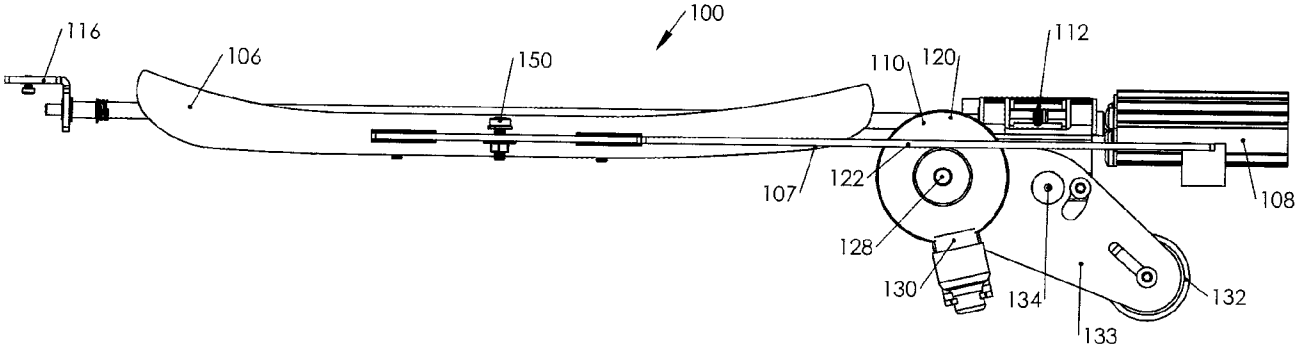
FIG. 2A is a side view of a portion of the blade sharpening apparatus showing a grinding wheel prior to engagement.
Figure 2B:
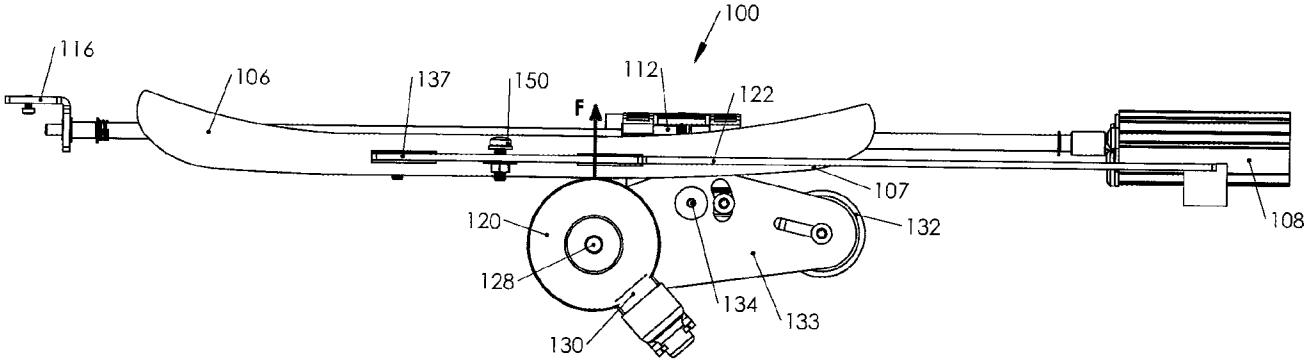
FIG. 2B is a side view of a portion of the blade sharpening apparatus showing a grinding wheel during engagement.

As best seen in FIGS. 2A-2B, the grinding wheel 120 is mounted on a rotatable spindle 128 that, in turn, is connected to a motor-unit 115 to drive the grinding wheel 120. FIG. 2A shows the grinding wheel 120 prior to engaging the skate blade 106 and FIG. 2B shows the grinding wheel 120 during operation i.e. when sharpening the bottom of the skate blade 106. The grinding wheel 120 may be made of steel with cubic boron nitride (CBN) or any other suitable material. Preferably, the grinding wheel has a pre-made profile such as a hollow radius or any other suitable profile. A sponge 130 may be placed close to the grinding wheel 120 for applying a cooling liquid to the grinding wheel 120 when it is used for grinding the skate blade 106 to sharpen edges of the blade 106. The grinding wheel 120 is in operative engagement, via a support 133, with a counter weight 132 that by gravity counter weighs the weight of the grinding wheel 120 to ensure that a correct grinding wheel pressure is applied against the blade 106 during the entire grinding process and so that the grinding wheel 120 can follow a contour 107 or shape of the blade 106 while applying a constant and correct grinding pressure against the blade 106 during the grinding process. Preferably, the counter weight 132 is mounted with rubber rings to smoothen the start of the grinding process. Both the grinding wheel 120 and the counter weight 132 on the support 133 are balanced about an axle 134 in the grinding mechanism 112. In this way, the grinding wheel 120 can smoothly follow the shape of the blade 106 as the support 133 pivots about axle 134 and the counter-weight 132 provides the counter-weight so that the correct grinding pressure by the grinding wheel 120 is used.

The grinding mechanism 112 has a wagon 113 for driving the grinding wheel 120 with low-friction glide-bushings in operative engagement with the bearing-mounted motor-unit 115. An electronic unit 117 includes the necessary electronic components to operate the apparatus 100 such as power supply and circuit board. The housing 102 has a side wall 103 and short-end walls 119 and 121 of which short-end wall 121 has a knob 123 for tightening the elongate clamp bars 122, 124 about the skate blade 106 inserted therebetween. By turning knob 123, the bars 122, 124 either moves away or towards the short-end wall 121. When the bars 122, 124 move towards the wall 121 a clamping pressure is applied about the skate blade 106. Of course, the apparatus 100 could also be constructed so that the clamping pressure is applied when the bars move away from wall 121. The wall 121 may have a switch 125 for turning on and off the apparatus 100. By turning on the switch 125, the motors 108 and 115 are turned on so that the grinding wheel 120 starts rotating to sharpen the blade 106 and the entire grinding mechanism 112 starts moving towards the blade 106. It is also possible that the apparatus may be activated by simply lowering the blade 106 into the housing 102 until a sensor starts the apparatus without the use of a manual switch 125.

Figure 3A:
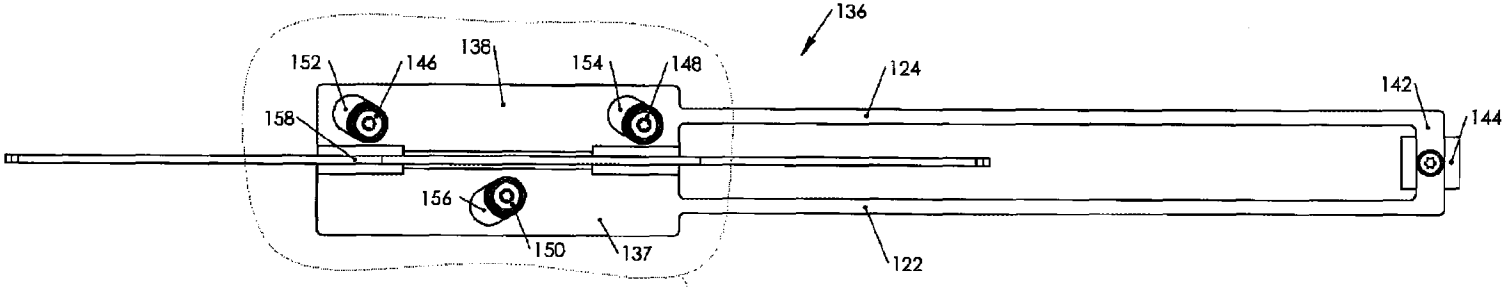
FIG. 3A is a schematic top view showing a self-centered clamp in an opened position.
Figure 3B:
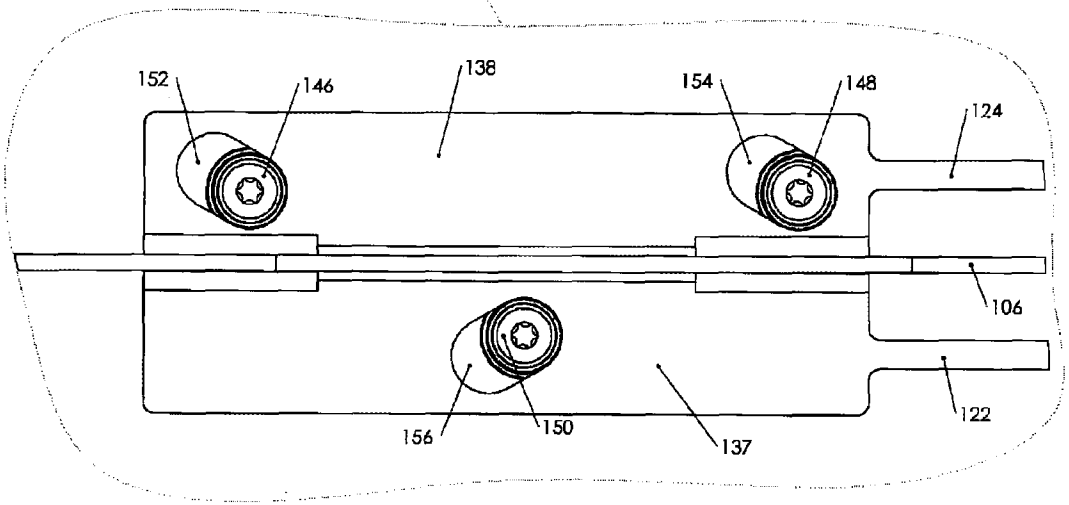
FIG. 3B is a detailed view of the self-centered clamp shown in FIG. 3A.
Figure 4A:
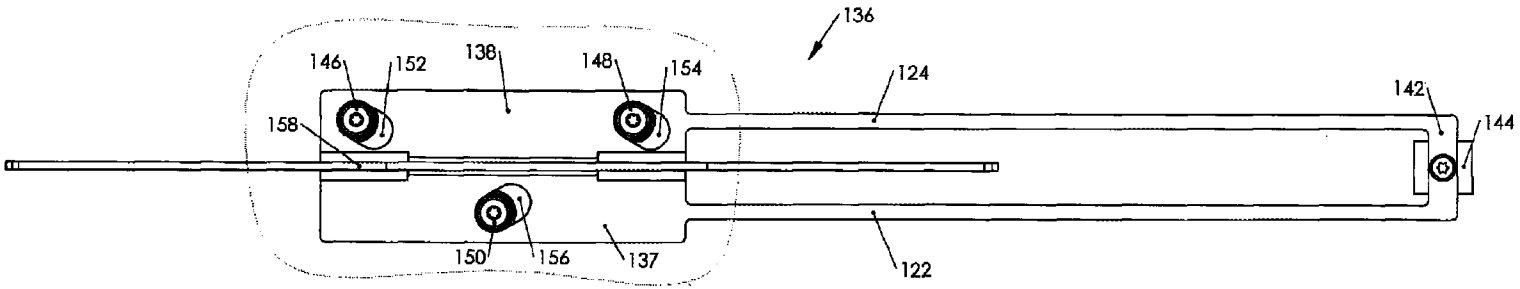
FIG. 4A is a top view of the clamp of FIG. 3A in a closed position.
Figure 4B:
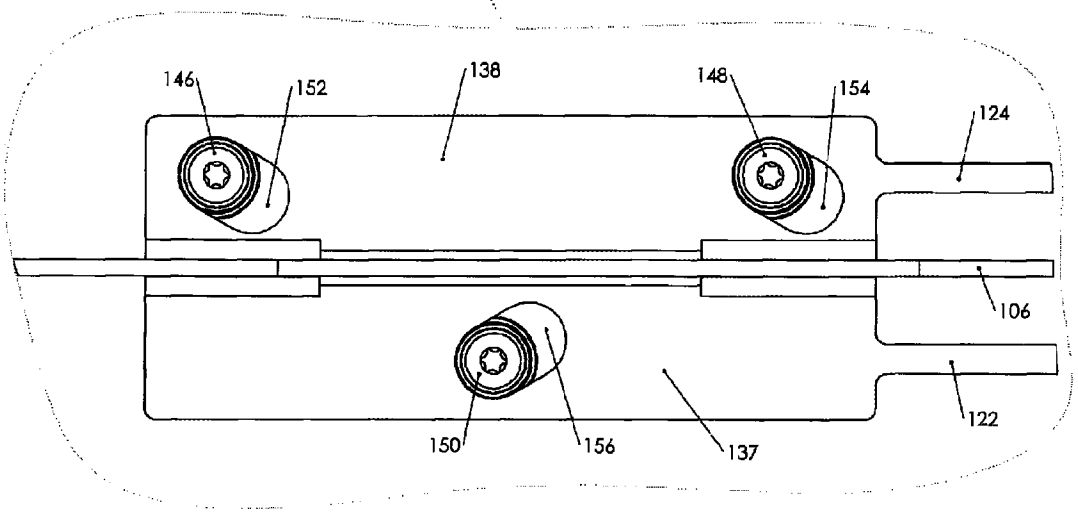
FIG. 4B is a detailed view of the self-centered clamp shown in FIG. 4A.

FIG. 3A is a top view of a clamping mechanism 136 of the present invention. The outer ends 140, 141 of bars 122, 124 have clamp holders 137, 138, respectively. An opposite end 142 has a threaded portion 144 for moving the clamping mechanism relative to the adjustment screws 146, 148 and 150 by turning knob 123 (shown in FIG. 1) because the knob 123 is in operative engagement with the threaded portion 144. The adjustment screws 146 and 148 are placed inside angled elongate openings 152, 154, respectively, of clamp holder 138 and the adjustment protrusions 150 is place inside an angled elongate opening 156 of clamp holder 137. An important feature is that the openings 152, 154 and 156 are at an angle, other than a right angle, relative to the movement of the clamping mechanism 136. By pulling the clamping mechanism 136 relative to the adjustment protrusions 146, 148 and 150, the protrusions slide relative to the elongate openings 152, 154 and 156, respectively, to move the clamping mechanism 136 between an opened position (see FIGS. 3A-3B) and a closed position (see FIGS. 4A-4B). When the clamping mechanism 136 is in the opened position a gap 158 is wide enough to receive the blade 106 and when the clamping mechanism is in the closed position, the gap 158 is tight to firmly hold the blade 106 during the grinding process. Because the clamping mechanism 136 is self-centered, the apparatus 100 can receive a wide range of blade widths.

Figure 6:
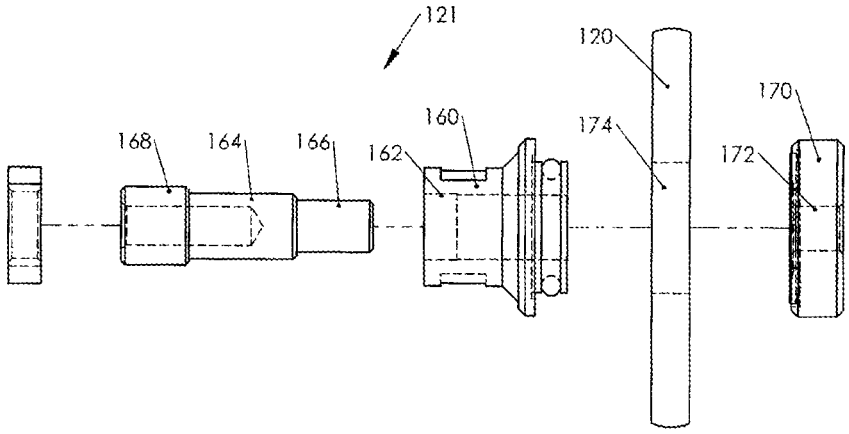
FIG. 6 is an exploded side view of the grinding wheel and the double-threaded fastening mechanism.

FIG. 6 is an exploded side view of the adjustable grinding wheel assembly 121 that has the grinding wheel 120 and an intermediate coupling 160 inserted into a central opening 174. The coupling 160 has a threaded opening 162 for receiving a threaded fastener 164 that has a first threaded outer portion 166 and a second threaded inner portion 168. When assembled the outer portion 166 engaged a threaded opening 172 of a wheel holder 170 that is placed on the other side of the grinding wheel and the inner portion 168 engaged the threaded opening 162. By turning the coupling 160 relative to the fastener 164 the sideways position of the grinding wheel 120 inside the groove 126 may easily be adjusted so that it is properly aligned with the blade 106.

Figure 7A:
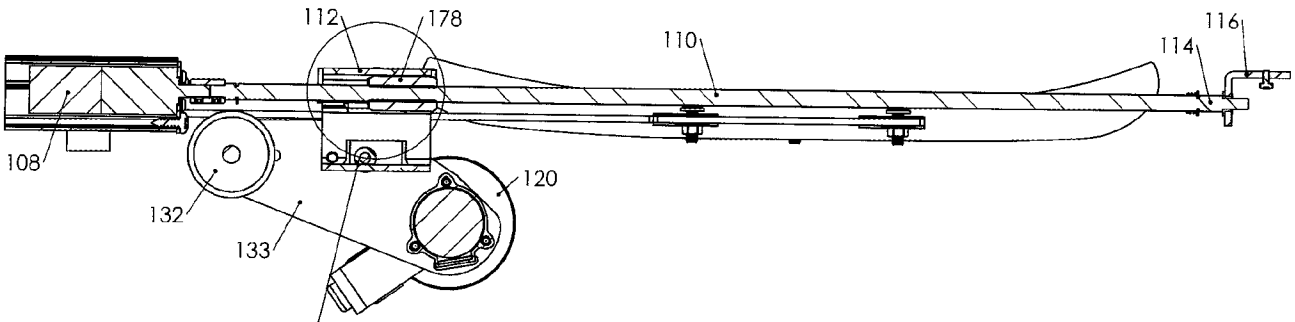
FIGS. 7A and 7B are side views of a portion of the apparatus showing a detail of the treaded lead screw.
Figure 7B:
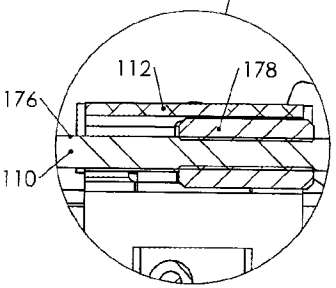

FIGS. 7A and 7B are side views of the threaded lead screw 110 engaging the grinding assembly 112. When motor 108 rotates the screw 110, the threaded outside 176 of the screw 110 engages a threaded portion 178 of the assembly 112 so that the entire assembly 112 moves relative to the screw 110 and relative to the blade 106 (not shown in FIG. 7) and so that the grinding wheel 120 moves along the blade 106 during the grinding or sharpening process.

In operation, the user simply places the blade 106 inside opening 104 and turns on the apparatus 100 by activating switch 125 so that the automatic self-centered clamping mechanism 136 can clamp the blade 106 and hold it firmly in place. Because the clamping mechanism 136 is automatic and self-centered relative to the position of the grinding wheel 120, it automatically adjusts itself to the width of blade 106. By turning on the apparatus 100, the grinding wheel 120 starts rotating and the grinding mechanism 112 starts moving towards the blade 106. The counter-weight 132 ensures that correct grinding pressure on the underside of the blade 106 is applied by the grinding wheel 120. Because both the counter-weight 132 and the grinding wheel 120 are rotatable or pivoting about axle 134, the grinding wheel 120 can smoothly follow contours or shape of the blade 106 without changing the grinding pressure applied thereon as the lead screw 110 feeds the entire grinding mechanism 112 along the blade 106.

While the present invention has been described in accordance with preferred compositions and embodiments, it is to be understood that certain substitutions and alterations may be made thereto without departing from the spirit and scope of the following claims.

The invention claimed is:

1. A method for sharpening a blade, comprising:

providing an automatic sharpening apparatus having a housing with an elongate opening defined therein, providing a lead screw extending along the housing and in operative engagement with a grinding mechanism, the lead screw having a first end attached to the housing and a free second end opposite the first end, a first motor mounted on the grinding mechanism, a second motor mounted on the second free end of the lead screw, placing a blade inside the elongate opening, tightening the blade between self-centered clamp holders, the first motor rotating a grinding wheel, the rotating grinding wheel engaging the blade, the second motor rotating the lead screw to move the grinding mechanism along the lead screw so that the grinding wheel automatically moves along the blade by following a contour of the blade, while the grinding wheel moving along the blade, a counter-weight providing a counter-weight to the grinding wheel, sharpening the blade while the blade being stationary inside the elongate opening of the housing.

2. The method according to claim 1 wherein the method further comprises the step of tightening the clamp holders about the blade by turning a knob.

3. The method according to claim 2 wherein the method further comprises the step of sliding protrusions relative to elongate openings.

4. The method according to claim 1 wherein the method further comprises the step of supporting the grinding wheel so that the grinding wheel moves between elongate bars in operative engagement with the grinding mechanism.

5. The method according to claim 1 wherein the method further comprises the step of axially adjusting a position of the grinding wheel between the elongate bars.

6. The method according to claim 5 wherein the method further comprises the step of the grinding wheel and the counter-weight pivoting about an axle of a support.

7. The method according to claim 5 wherein the method further comprises the step of turning an intermediate coupling relative to a threaded fastener both in operative engagement with the grinding wheel to move the grinding wheel relative to the elongate bars.

* * * * *